US006409231B1

(12) United States Patent
Rusiana

(10) Patent No.: US 6,409,231 B1
(45) Date of Patent: Jun. 25, 2002

(54) FLUSH BOLT MECHANISM

(75) Inventor: Arturo Rusiana, Algonquin, IL (US)

(73) Assignee: Architectural Builders Hardware Manufacturing Inc., Elk Grove Village, IL (US)

( * ) Notice: Subject to any disclaimer, the term of this patent is extended or adjusted under 35 U.S.C. 154(b) by 0 days.

(21) Appl. No.: 09/409,496

(22) Filed: Sep. 30, 1999

(51) Int. Cl.[7] ..... E05C 1/06
(52) U.S. Cl. ..... 292/33; 292/332; 292/DIG. 21
(58) Field of Search ..... 292/33, 332–336, 292/DIG. 21, DIG. 60

(56) References Cited

U.S. PATENT DOCUMENTS 3,899,203 A * 8/1975 Heitz ..... 292/335
4,005,886 A * 2/1977 Lirette ..... 292/177
4,262,504 A * 4/1981 Inoue ..... 70/151 R
4,445,717 A 5/1984 Imhoff
5,076,620 A * 12/1991 Campbell ..... 292/138
5,154,454 A * 10/1992 Hollaway ..... 292/21
5,524,941 A * 6/1996 Fleming ..... 292/34
6,120,071 A * 9/2000 Picard ..... 292/165

* cited by examiner

*Primary Examiner*—Gary Estremsky
(74) *Attorney, Agent, or Firm*—Patnaude & Videbeck

(57) ABSTRACT

A flush bolt mechanism for use in connection with a pair of swingable doors to provide latch bolt engagement between the free ends of those doors. The flush bolt mechanism includes a generally flat frame or plate adapted to be mounted on a flat frame or plate adapted to be mounted flush on one of the free ends of the swingable doors, and a support bracket mounted on the back thereof. The support bracket provides a means for mounting an adjustment bracket thereon in reciprocal position thereon. A trigger mechanism is also mounted in reciprocal position on the support bracket so as to extend through the flush mounted plate. The trigger mechanism and the adjustment bracket are mounted on the flat plate and the support bracket to be reciprocally moved toward the plate and away from the plate in continuous adjustment to provide for adjusting the extended position of the trigger means mounted on the adjustment bracket.

7 Claims, 5 Drawing Sheets

FLUSH BOLT MECHANISM

The present invention relates to latches or bolts used in doorways, and, more particularly, to a flush bolt mechanism used in connection with a double door as the latch mechanism mounted on the door that normally remains closed.

BACKGROUND OF THE INVENTION

Flush bolt mechanisms are used on what is normally termed the inactive door of a pair of double swinging doors. The flush bolt mechanism includes the male member (trigger) of a door latch combination with the female bolt receiving plate or strike positioned in the opposing active door. While a major portion of the flush bolt mechanism is mounted on what is termed the free side of the inactive door, an additional latch bolt and guide mechanism are connected to the flush bolt mechanism by a long linkage to provide a locking bolt that is normally received in a second strike positioned in the lentil of the doorway.

Flush bolt mechanisms are shown and described at U.S. Pat. Nos. 4,005,886; 4,445,717; and 5,076,620.

With a double set of swinging doors, the space between opposing door jambs, in the walls in which the doors are mounted, should provide for clearance between the jamb and the pivoting side of each of the opposing doors plus clearance between the free sides of the opposing doors. Heretofore, the preferred way of adjusting the doors and the door locking mechanisms thereon for a double set of swinging doors has included shimming the hinges in the door jambs. As the clearances in a double set of swinging doors are greater than that found in a single swinging door, a need has developed for a new and improved means of adjusting a door bolt mechanism to accommodate varying clearances found on site between the double swinging doors and the door sash.

It is, therefore, an object of the present invention, generally stated, to provide a new and improved flush bolt mechanism for a dual swinging door assembly.

SUMMARY OF THE INVENTION

The invention resides in a flush bolt mechanism for mounting on the free edge of one of a pair of swingable doors which provides latch bolt engagement between those doors when they are in a closed position mounted in their associated sash. The flush bolt mechanism comprises frame means including a generally flat surface adapted for flush mounting on the free end of one of the pair of swingable doors. The generally flat surface has an aperture therethrough. The invention further includes trigger means mounted for reciprocal movement on the frame means perpendicularly to the generally flat surface and positioned to extend through the first aperture for providing a latch bolt between the pair of swingable doors. The reciprocal mounting of the trigger means includes an extended position wherein the trigger means is adapted for engagement with a strike in the opposing one of a pair of swingable doors. It also includes a retracted position wherein a distal end of the trigger means is withdrawn to a position of non-engagement of a strike on the opposing one of a pair of swingable doors. The invention includes means on the frame means for adjusting the extended position of the trigger means to accommodate differences in the space between the free ends of the swingable doors.

BRIEF DESCRIPTION OF THE DRAWINGS

The features of the present invention which are believed to be novel are set forth with particularity in the appended claims. The invention, together with further objects and advantages thereof may best be understood by reference to the following description taken in connection with the accompanying drawings, wherein like reference numerals identify like elements throughout, and in which:

DETAILED DESCRIPTION OF THE PREFERRED EMBODIMENTS

Figure 1:
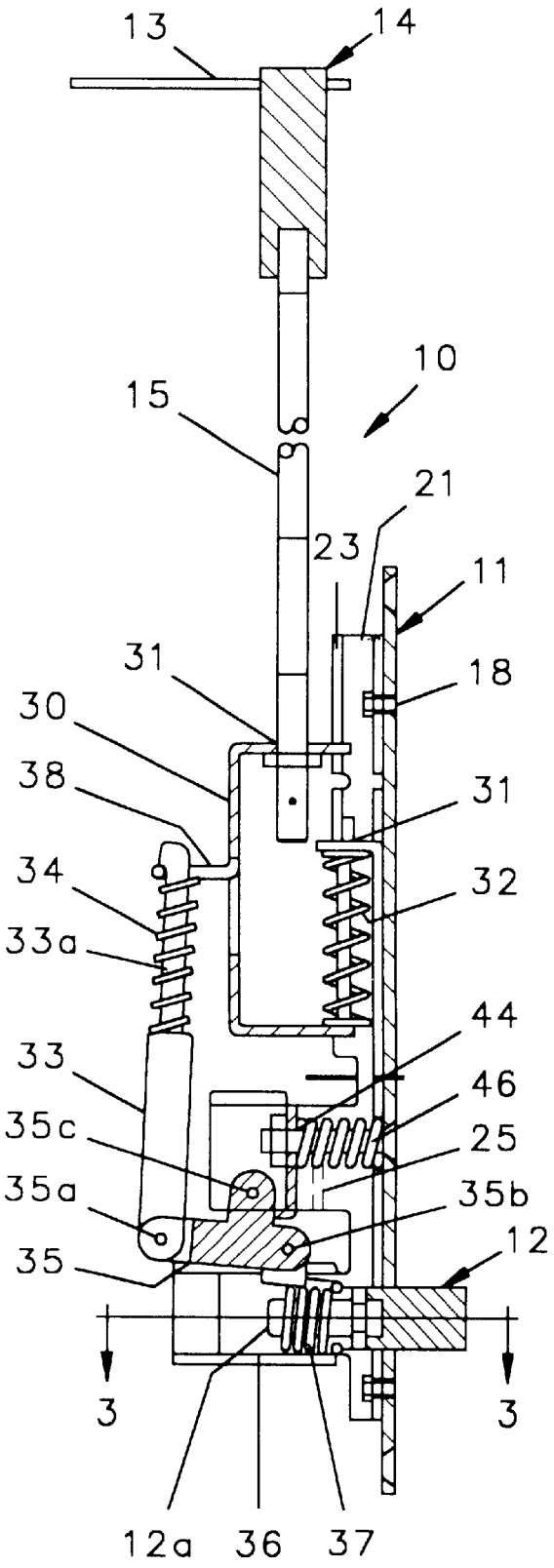
FIG. 1 is a vertical sectional view of a flush bolt mechanism, constructed in accordance with the present invention, with the horizontally acting trigger or latch being in extended position.

Referring to FIG. 1, the flush bolt mechanism, generally indicated at 10, constructed in accordance with the present invention, is shaped to mount in a cavity (not shown) on the free vertical side of a swinging doorway, with the outside surface of the base mounting plate 11 visible at the free surface of the inactive door of a pair of swinging doors and a first latch bolt or trigger 12 extending outwardly from the base plate. Additionally, the top surface of the door (not shown) also includes a recess on which a guide 13 is mounted with a second latch bolt 14 positioned to reciprocally extend therethrough to maintain the door lock in its door sash (not shown) as an inactive door, or in a retracted position to allow both swinging doors to open. It should be noted that the inactive door may include a second latch bolt for latching the door to either the lintel, the threshold or a third independently operated latch bolt for latching the door to both.

Figure 2:
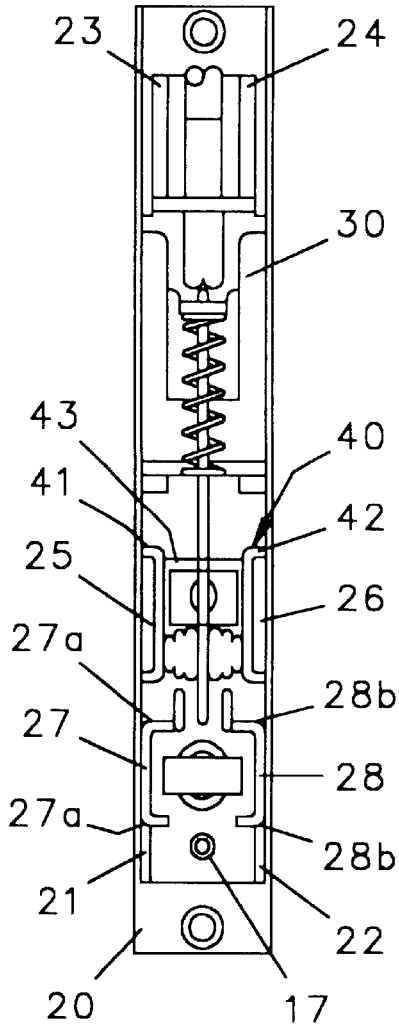
FIG. 2 is a left end view of the flush bolt mechanism minus the lentil bolt thereof.
Figure 4:
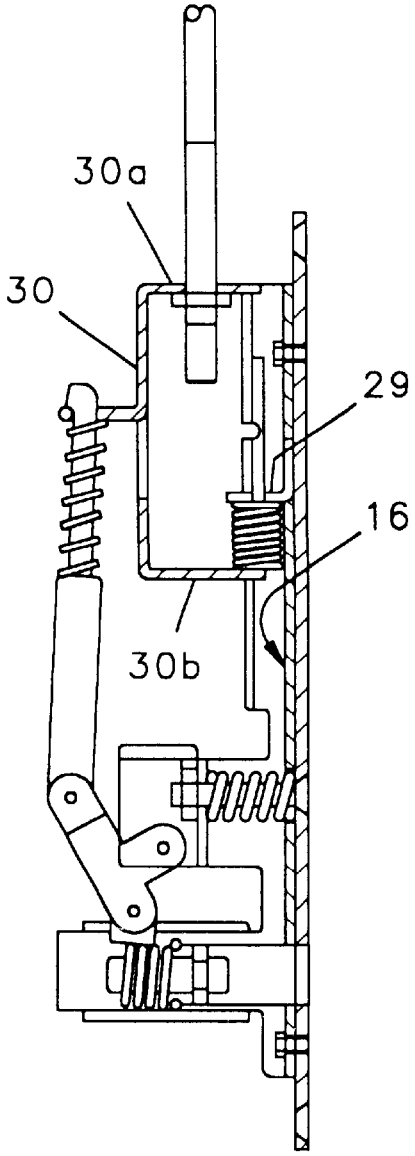
FIG. 4 is a front elevational view of the flush bolt mechanism minus the lentil bolt as it appears with the trigger in retracted position.

Second latch bolt 14 is connected to the main mechanism by an elongate rod type linkage 15. As seen most clearly in FIGS. 1 and 2, a support bracket, generally indicated at 16, is fastened to the back (non exposed) side of the base mounting plate 11 by rivets 17, 18, and includes guide channels, to be discussed in more detail below. In the preferred embodiment, the support bracket is made of sheet metal and includes a central flat base or bite portion 20. At the opposed elongate sides of the base portion 20 are formed two upwardly extending side walls 21, 22. Each side wall is divided into three different operating areas along its length.

Adjacent the top of the side wall, the distal end of each of the side walls 21, 22 is bent inwardly to form a C-shaped channel at flanges 23, 24, respectively. Second, the central portion of the side walls 21 and 22 each include a vertical upstanding wall, identified as 25, 26, respectively. Third, the bottom portion of each of the side walls 21, 22 includes an upstanding wall portion 27, 28, respectively, and each of those portions include a pair of opposed vertically bent flanges 27*a*, 27*b* and 28*a*, 28*b*, respectively, to define a pair of spaced vertical C-channels in which the latch bolt or trigger 12 and its assorted mechanisms is reciprocally retained.

A C-shaped slide-guide 30, includes a quartet of notched portions (not shown) that ride on the distal channels 23, 24, respectively, of the upper portion of the support bracket 16 to allow the slide-glide 30 to reciprocate vertically in those channels. The top wall 30*a* of the slide-glide 30 includes a threaded bore 31 in which the bottom end of link 15 is adjustably retained. A coil spring 32 is positioned between the bottom wall 30*b* of the slide-glide 30 and a bracket 29 positioned in the C-channel defined by flanges 23, 24 biases the slide-glide in a downward position but allows the rod 15 and second latch bolt 14 to be moved into an upward lentil engaging position when desired. It should also be noted that a mechanical lever mechanism (not shown) which is known in the art, may be positioned in the free end of the inactive door adjacent rod 15 between the slide-glide 30 and the second latch bolt 14 to provide positive mechanism for locking the bolt 14 into the upper door lentil and unlocking same as desired. Slide glide 30 also includes a horizontally extending flange 32 which retains the distal end of a link mechanism 33 therein. Link mechanism 33 is generally retained in its position on flange 32 by means of a coil spring 34. However, whenever necessary, the coil spring allows the upper narrow end 33*a* of link 33 to slide through an aperture on flange 32 as an override if the second latch bolt does not line up with the lentil strike.

Figure 3:
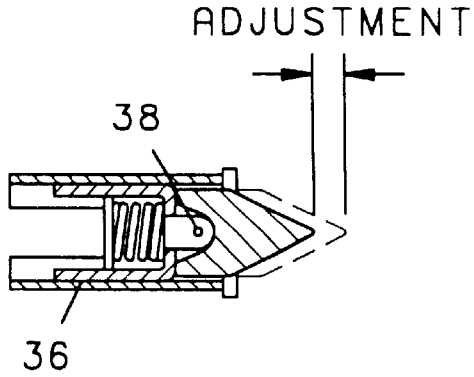
FIG. 3 is a cross-sectional view taken substantially along line 3—3 of FIG. 1 showing the range of adjustability of the horizontally movable trigger in its extended position.

In operation, it is desirable that when the first latch bolt 12 of the inactive door is engaged, it means that relative movement between the free ends of the opening door and the inactive door is taking place, and it is desirable that the second strike 14 be in its upward position to provide engagement of the inactive door with the transom. To accomplish this, link 33, positioned in connection with slide-glide 30, is connected to a pivoting bell crank 35 at one free end 35*a* thereof, the other free end 35*b* being pivotally mounted to a plunger mechanism 36 (FIG. 3) which is slidably retained between the trigger 12 and the horizontal C-channel walls 27, 28, respectively. Plunger 36 is U-shaped to include a pair of horizontally extending walls and a bite portion having an aperture (not shown) that receives the upper end 12*a* of latch bolt 12 and a coil spring 37 which is retained between the bite portion of the plunger and the upper end of the strike 12. The trigger 12 is pivotally mounted to the upper end of latch bolt 12*a* at pivotal mounting 38 to allow the strike to move not only in reciprocal retraction, but also radially as it retracts in response to perpendicular force from the active door.

An important aspect of the present invention resides in the reciprocally movable pivot 35*c* of the bell crank 35. Pivot 35*c* is mounted on an adjustment bracket 40 that includes two outwardly facing C-channel sides 41, 42, respectively, and a horizontal bite portion 43 having a threaded aperture 44 therethrough. The outwardly facing portions 41, 42 of the adjustment bracket ride on the horizontal central flat walls 25, 26 of the base mounting plate 11 in order to move the pivot point 35 and its associated plunger 36 in its respective C-channels 27, 28. Control of the amount and position of the reciprocal adjustment bracket is determined by a phillips head screw 45 positioned through an aperture in the base mounting plate and the threaded aperture 44 in the support bracket 16. It is biased in an inward position by a coil spring 46, positioned between the bite portion 43 and the support bracket 16. By turning the phillips head screw 45, the adjustment bracket 40 is reciprocated along flat central wall portions 25, 26. As the adjustment bracket and plunger mechanism reciprocate, the trigger, mounted on the plunger, also reciprocates from the position shown in solid line in FIG. 3 to and including the position shown in dotted line in FIG. 3.

Referring to FIGS. 1–4, in operation when the first latch bolt or trigger 12 is pushed back into the plunger 36 as the active door is being closed, the bell crank 35 moves to push the slide-glide 30 upward through link 33 to move long link 15 upward and make sure the second latch bolt 14 is inserted into the recess or strike in the door lentil (not shown). It should be noted that the spring 34 provides an override if the second latch bolt 14 is not lined up with the strike in the lentil.

Referring to FIGS. 5, 6, 7 and 8, a second embodiment of the preferred invention, generally indicated at 60, operates similarly to the first embodiment 10 with several exceptions. Like the first embodiment, the second embodiment 60 includes a base mounting plate 61 similar to base mounting plate 11. However, instead of having an elongate support bracket 16, the second embodiment 60 does away with same and utilizes a pair of L-shaped brackets 62, 63 with bracket 62 fixedly mounted to the mounting plate 61, and bracket 63 slidably mounted to the mounting plate 61 to replace the slide-glide 30 of the first embodiment. Similar to the first embodiment, the second flush bolt mechanism 60 includes an elongate rod 63 in place of rod 15 of the first embodiment. Rod 63 slides through apertures 62*a*, 63*a* in L-shape brackets 62, 63, respectively, and is retained in a limited movement position therein by a pair of coil springs 64, 65, fixedly mounted to stop 66 on the reciprocating rod 63.

Figure 5:
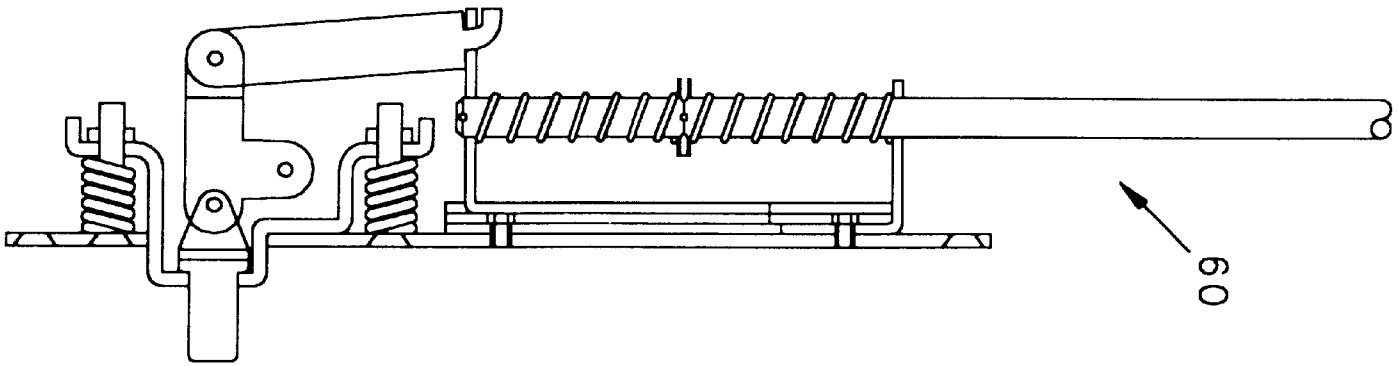
FIG. 5 is a vertical elevational view of a second embodiment of the present invention utilizing a dual adjustable bracket for mounting the trigger and the linkage pivot shown in extended position with the trigger also extended.
Figure 6:
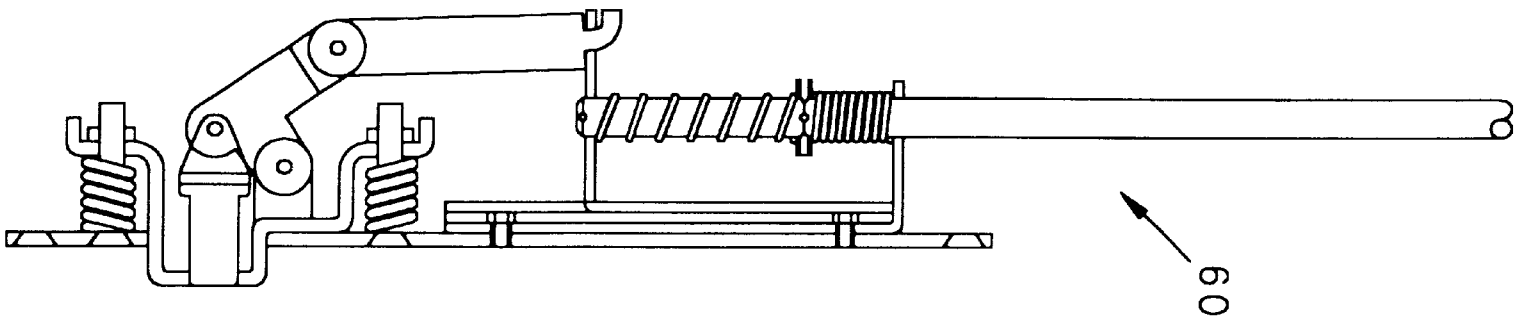
FIG. 6 is a front elevational view similar to FIG. 5 of a second embodiment of the present invention showing the trigger in retracted position with the adjustment bracket shown in extended position.
Figure 7:
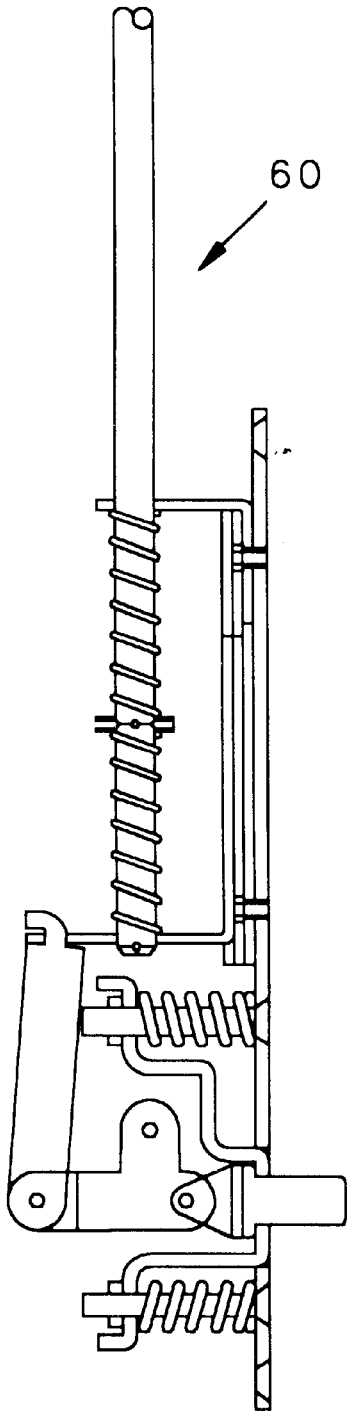
FIG. 7 is a vertical elevational view similar to FIG. 5 showing the adjustable bracket of the present invention in retracted position with the trigger shown in extended position.
Figure 8:
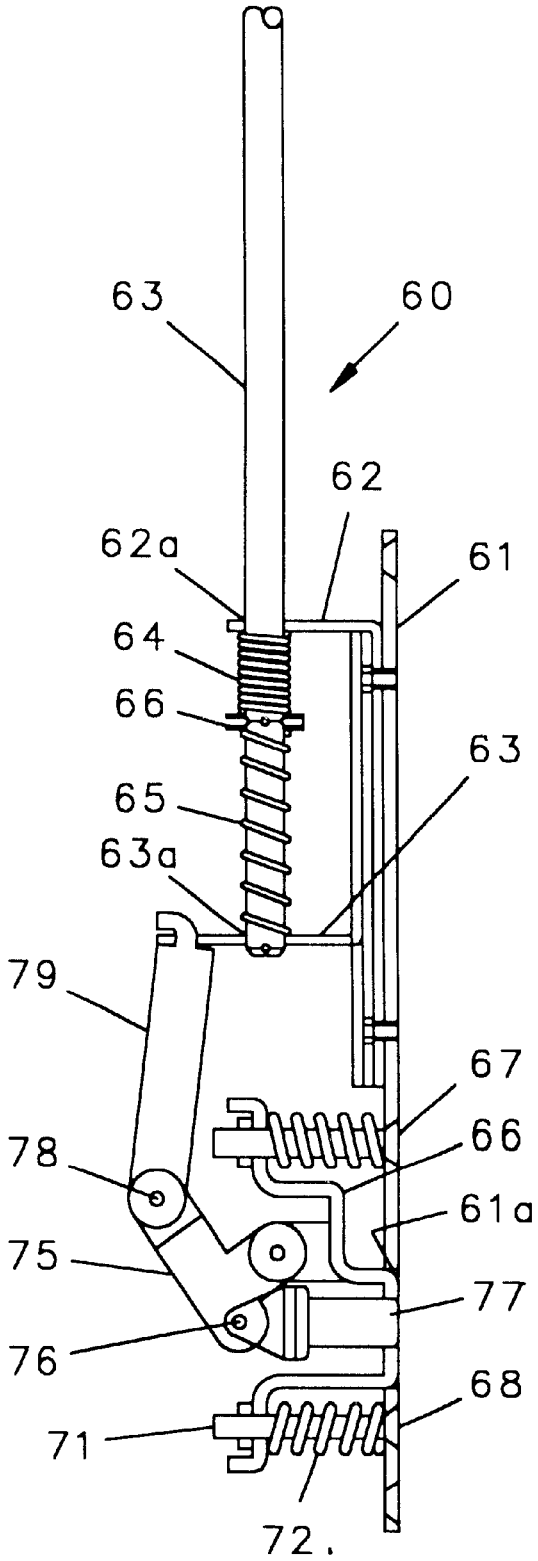
FIG. 8 is a vertical elevational view similar to FIG. 5 showing the adjustment bracket in retracted position and the trigger also in retracted position.
Figure 9:
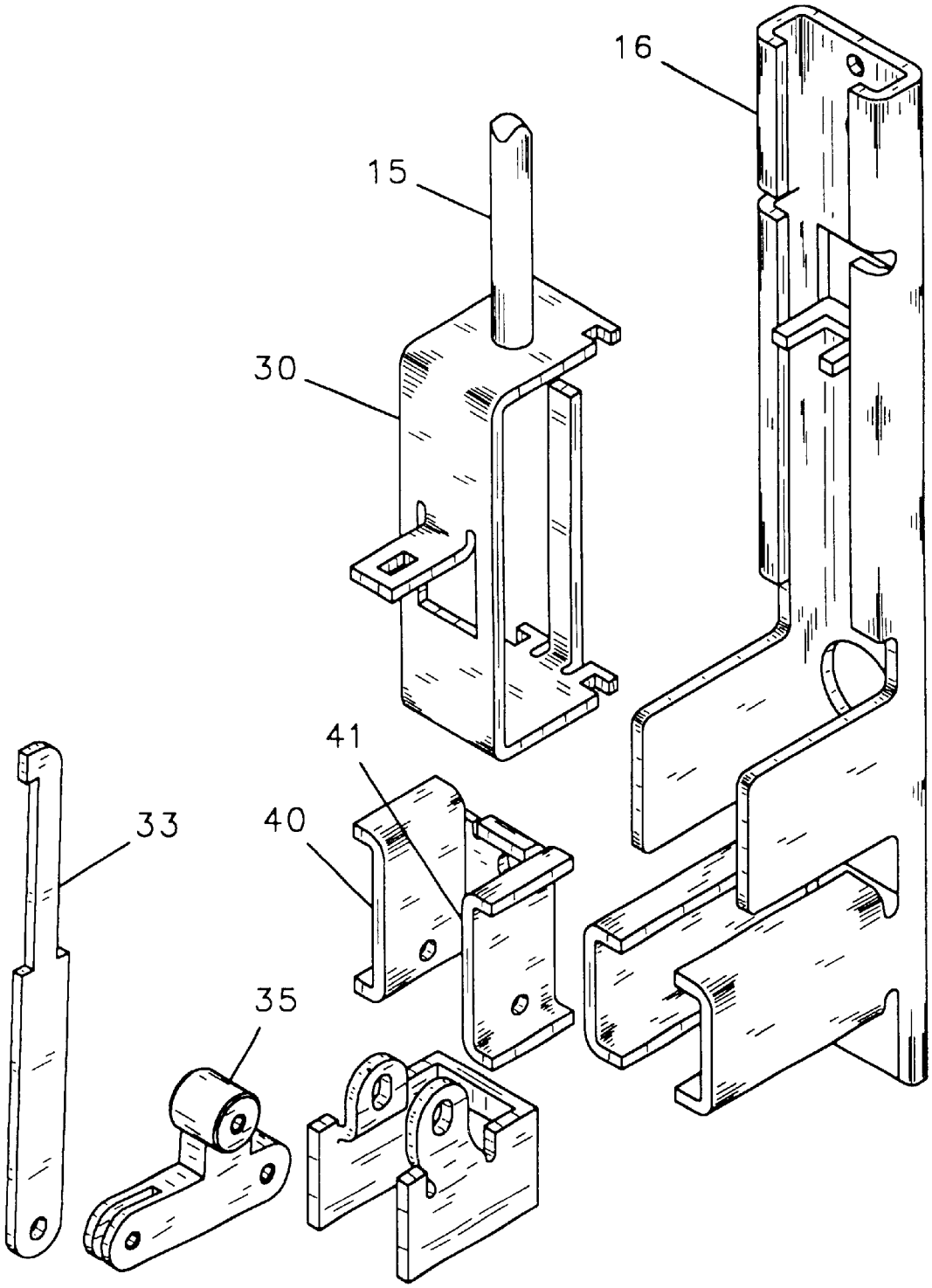
FIG. 9 is an exploded perspective view of certain parts of the flush bolt mechanism.

Instead of the support bracket, adjustment bracket, and plunger of the first embodiment, the second embodiment includes an adjustment bracket 66 which is made infinitely reciprocally adjustable with respect to the mounting plate 61 by the use of a pair of phillips screws 67, 68, respectively, which are secured through threaded apertures 70, 71, on the opposing outer portions of the adjustment bracket 66. Coil spring 72, 73, bias the adjustment bracket 66 in a position where it is retracted from an aperture 61a in base mounting plate 61. As with adjustment bracket 40, of the first embodiment, adjustment bracket 66 includes a pivotal mounting thereon 74, which provides a mounting for bell crank 75. Bell crank 75 is mounted at one end 76 to the upper end of a trigger 77 and at its other end 78 to a link 78 connected to the upper end of L-shaped bracket 63. In an important aspect of the present invention, the pair of phillips screws 67, 68 may be turned to either retract the adjustment bracket 66 into the doorway so that it is flush with the mounting plate 61 as shown in FIGS. 7 and 8, or they may be turned so the adjustment bracket 66 is extended outwardly through the mounting plate 61 as shown in FIGS. 5 and 6, thus providing adjustability of the engagement between the trigger 77 and the strike of the active door (not shown). In FIG. 5, the mechanism is shown in the no-actuation position, with the trigger 77 in its most extended position and the lentil bolt (not shown) in its retracted position as denoted by the length of the rod between the vertical portions of L-shaped brackets 62 and 63. FIG. 6 shows the flush bolt mechanism 60 in its normal actuation position with the trigger recessed completely in the adjustment bracket 66. The long link 63 is in its extended position so that the top door bolt (not shown) will extend into the lentil strike (not shown) of the sash. FIG. 7 shows the adjustment bracket 66 positioned in its most retracted position with the trigger 77 in a no-actuation position, and FIG. 8 shows the trigger 77 in an actuated position but where the top door bolt and strike (not shown) do not line up so that a compensation or override position is required as shown by the position of the springs 65 and 64.

Thus, applicant has shown two embodiments of the flush bolt mechanism, one having a single threaded adjustment screw mounted on the adjustment bracket, and the second having a pair of opposed adjustable screws positioned on either side of the trigger mechanism and utilizing a larger adjustment bracket but eliminating the plunger mechanism of the first embodiment. Both of the flush bolt mechanisms of the present invention provide for adjustability within the limits set for the adjustment bracket for varying the total distance the trigger extends from the outer visible side of the flush bolt mechanism mounting plate.

Thus, a new and improved adjustment means for varying the extension distance of a flush bolt mechanism has been shown and described.

While two embodiments of the present invention have been shown and described, it will be understood by those skilled in the art that many changes and modifications may be made without departing from the true spirit and scope of the present invention. It is the intent of the appended claims to cover all such changes and modifications which fall within the true spirit and scope of the invention.

What is claimed:

1. A flush bolt mechanism for mounting on the free edge of one of a pair of swingable doors for providing latch bolt engagement therebetween when said doors are in a closed position in their associated sash, said flush bolt mechanism comprising:

a frame including a generally flat front sheet adapted for flush mounting on the free edge of said pair of swingable doors, a support bracket secured on a back side of said generally flat front sheet, said support bracket including an elongate base or bight portion and a pair of elongate opposed side walls extending perpendicularly in like direction from opposing elongate sides of said base, each of said side walls including an elongate distal wall perpendicular to said side wall in a like direction to said base defining, with said opposing side wall, a first elongate channel portion parallel to said bight portion, a second portion of said side wall being flat and perpendicular to said bight portion and extending beyond said distal wall of said first portion, and a third portion of said side wall including a main wall extending perpendicularly from said bight portion similarly to said second portion and further including second and third elongate distal walls extending in like direction perpendicular to said main wall and also perpendicular to said bight portion defining with said opposing side wall a substantially square channel.

2. The flush bolt mechanism as called for in claim 1 further including, plunger means reciprocally retained on said square channel for mounting a trigger mechanism thereon, said plunger means including a flat central portion having an aperture therethrough for mounting a trigger mechanism thereon, and a pair of opposed wing portions extending in like direction perpendicular to said central portion for riding in opposed portions of said square channel.

3. The flush bolt mechanism as called for in claim 1 further including, a slide-glide bracket reciprocally mounted on said first portion of said support bracket including an elongate central portion having a link mounting flange extending perpendicularly extending distal ends shaped to be received on said first elongate channel portion of said support bracket for reciprocal mounting thereon parallel to said flat front sheet.

4. The flush bolt mechanism as called for in claim 1 further including, an adjustment bracket reciprocally mounted on said second portion of said support bracket, said adjustment bracket including a pivotal mounting thereon, and a threaded aperture therethrough, a threaded rod having means for rotating same on an end thereof mounted through said generally flat front sheet and through said threaded aperture on said adjustment bracket, and means between said generally flat front sheet and said adjustment bracket for biasing said adjustment bracket away from said generally flat front sheet.

5. The flush bolt mechanism as called for in claim 1 further including, plunger means reciprocally retained on said square channel for mounting a trigger mechanism thereon, said plunger means including a flat central portion having an aperture therethrough for mounting a trigger mechanism thereon, and a pair of opposed wing portions extending in like direction perpendicular to said central portion for riding in opposed portions of said square channel, a slide-glide bracket reciprocally mounted on said first portion of said support bracket including an elongate central portion having a link mounting flange extending perpendicularly extending distal ends shaped to be received on said first elongate channel portion of said support bracket for reciprocal mounting thereon parallel to said flat front sheet, an adjustment bracket reciprocally mounted on said second portion of said support bracket, said adjustment bracket including a pivotal mounting thereon, and a threaded aperture therethrough, a threaded rod having means for rotating same on an end thereof mounted through said generally flat front sheet and through said threaded aperture on said adjustment bracket, and means between said generally flat front sheet and said adjustment bracket for biasing said adjustment bracket away from said generally flat front sheet.

6. A flush bolt mechanism for mounting on the free edge of one of a pair of swingable doors for providing latch bolt engagement therebetween when said doors are in a closed position in their associated sash, said flush bolt mechanism comprising:

frame means including a generally flat surface adapted for flush mounting on the free end of one of the pair of swingable doors, said generally flat surface having at least a first aperture therethrough, trigger means mounted for reciprocal movement on said frame means perpendicularly to said generally flat surface and positioned to extend through said first aperture for providing a latch bolt between the pair of swingable doors, the reciprocal mounting of said trigger means including an extended position wherein said trigger means is adapted for engagement with a strike on the opposing one of a pair of swingable doors, and a retracted position wherein a distal end of said trigger means is withdrawn to a position of non-engagement with a strike on the opposing one of a pair of swingable doors, means on said frame means for adjusting the extended position of said trigger means for accommodating differences in the space between the free ends of said swingable doors, said means on said frame means for adjusting the extended position of said trigger means includes, an adjustment bracket reciprocally mounted on said frame means including a first threaded aperture therethrough, a second aperture through said generally flat surface of said frame means, a first adjustment screw extending through said second aperture on said frame means and said first threaded aperture on said adjustment bracket, and first bias means positioned between said generally flat surface on said frame means and said adjustment bracket for biasing said adjustment bracket away from said generally flat surface.

7. A flush bolt mechanism for mounting on the free edge of one of a pair of swingable doors for providing latch bolt engagement therebetween when said doors are in a closed position in their associated sash, said flush bolt mechanism comprising:

frame means including a generally flat surface adapted for flush mounting on the free end of one of the pair of swingable doors, said generally flat surface having at least a first aperture therethrough, trigger means mounted for reciprocal movement on said frame means perpendicularly to said generally flat surface and positioned to extend through said first aperture for providing a latch bolt between the pair of swingable doors, the reciprocal mounting of said trigger means including an extended position wherein said trigger means is adapted for engagement with a strike on the opposing one of a pair of swingable doors, and a retracted position wherein a distal end of said trigger means is withdrawn to a position of non-engagement with a strike on the opposing one of a pair of swingable doors, means on said frame means for adjusting the extended position of said trigger means for accommodating differences in the space between the free ends of said swingable doors, said means on said frame means for adjusting the extended position of said trigger means includes, an adjustment bracket reciprocally mounted on said frame means including a first threaded aperture therethrough, and second aperture through said generally flat surface of said frame means, a first adjustment screw extending through said second aperture on said frame means and said first threaded aperture on said adjustment bracket, and first bias means positioned between said generally flat surface on said frame means and said adjustment bracket for biasing said adjustment bracket away from said generally flat surface, said adjustment bracket includes a second threaded aperture therethrough, said first and second apertures being positioned on opposing sides of said trigger means, a second adjustment screw extending through a third aperture on said frame means and said second threaded aperture on said adjustment bracket, said second and third apertures through and frame means being positioned on opposing sides of said first aperture therethrough, and said first and second threaded screws being positioned on opposing sides of said trigger means.

* * * * *